US006325023B1

(12) United States Patent
Elnatan

(10) Patent No.: US 6,325,023 B1
(45) Date of Patent: Dec. 4, 2001

(54) METHOD AND APPARATUS FOR ASSISTING A CHILD TO WALK

(76) Inventor: Deborah Ocko Elnatan, Jerusalem (IL)

( * ) Notice: Subject to any disclaimer, the term of this patent is extended or adjusted under 35 U.S.C. 154(b) by 0 days.

(21) Appl. No.: 09/556,911

(22) Filed: Apr. 21, 2000

(51) Int. Cl.[7] ..... A62B 35/00; A42B 3/00
(52) U.S. Cl. ..... 119/770; 2/44
(58) Field of Search ..... 119/770, 772, 119/792, 795; 2/44, 45; 602/4

(56) References Cited

U.S. PATENT DOCUMENTS

| | | | | |
|---|---|---|---|---|
| D. 383,256 | * | 9/1997 | Hampton | 119/770 |
| 1,651,561 | * | 12/1927 | Storey | 119/770 |
| 2,761,223 | | 9/1956 | Legeai . | |
| 2,860,424 | | 11/1958 | McKinnon . | |
| 3,721,436 | | 3/1973 | Barthel, Jr. . | |
| 3,761,082 | | 9/1973 | Barthel, Jr. . | |
| 4,430,990 | * | 2/1984 | Whitehead | 2/44 |
| 4,450,991 | | 5/1984 | Gougeon . | |
| 4,553,633 | | 11/1985 | Armstrong et al. . | |
| 4,569,336 | | 2/1986 | Wheeler . | |
| 4,922,860 | | 5/1990 | Hutchings . | |
| 4,944,057 | | 7/1990 | Shaw . | |
| 5,038,761 | | 8/1991 | Richardson . | |
| 5,119,767 | | 6/1992 | Jimenez . | |
| 5,120,287 | | 6/1992 | Brown et al. . | |
| 5,152,730 | | 10/1992 | Hoffman . | |
| 5,356,355 | | 10/1994 | Campbell . | |
| 5,409,437 | | 4/1995 | Lauro et al. . | |
| 5,435,272 | * | 7/1995 | Epstein | 119/770 |
| 5,458,550 | | 10/1995 | Braim et al. . | |
| 5,476,070 | * | 12/1995 | Gwon et al. | 119/770 |
| 5,498,219 | | 3/1996 | Soufi . | |
| 5,540,188 | * | 7/1996 | Heinrichs | 119/770 |
| 5,569,129 | | 10/1996 | Seif-Naraghi et al. . | |
| 5,588,841 | | 12/1996 | Mechling . | |
| 5,632,425 | | 5/1997 | Hull . | |
| 5,806,466 | * | 9/1998 | Pintor et al. | 119/770 |
| 5,860,944 | * | 1/1999 | Hoffman, Jr. | 2/44 |
| 6,125,792 | * | 10/2000 | Gee | 119/770 |

* cited by examiner

*Primary Examiner*—Charles T. Jordan
*Assistant Examiner*—Elizabeth Shaw
(74) *Attorney, Agent, or Firm*—Stuart E. Beck

(57) ABSTRACT

A method and apparatus for enabling a larger person to assist a smaller disabled person to learn to stand and to walk while keeping the hands of both persons free for other tasks. The apparatus comprises two body harnesses and a foot harness. One of the body harnesses is worn by the larger person and the second body harness is worn by the smaller person. The foot harness is worn by both persons. The first and second harnesses are connected to each other to enable the smaller person to have substantial freedom of movement while the larger person supports and assists the smaller person to walk.

A apparatus for enabling a larger person to assist a smaller disabled person to learn to stand and walk while keeping the hands of both persons free for other tasks. The apparatus comprises a harness which is worn by the larger person. The harness is connected to the smaller person so that the smaller person has substantial freedom of movement while the larger person assists the smaller person to walk.

64 Claims, 4 Drawing Sheets

METHOD AND APPARATUS FOR ASSISTING A CHILD TO WALK

FIELD OF THE INVENTION

This invention relates to a method and apparatus for permitting an able-bodied person to assist a smaller disabled person and more particularly, to a method and apparatus which enables an able-bodied person to provide a smaller disabled person with a normal standing and walking experience and model that includes gait components such as time, cadence and step width.

BACKGROUND OF THE INVENTION

Children who are developmentally delayed or who suffer from muscular/skeletal impairments often have difficulty standing and/or walking independently. For standing and/or walking they often use a variety of lightweight and portable devices such as walkers, canes and crutches. In some instances they may need standers for assisted standing and gait trainers for assisted walking.

Daily assisted standing and walking are beneficial and create the opportunity for good bone and muscle development. As compared to other positions such as sitting and lying, standing and walking allow many more possibilities for the disabled child to actively interact and initiate socially and physically within his/her environment.

However, many children, though, have no or limited access to these essential standers and gait trainers. They are costly, heavy and bulky. Further, they are generally designed for indoor use only. Thus, even if they are available at the child's home, (pre)school, or treatment clinic; they are rarely moved from location to location with the child.

The problems associated with the use of standers and gait trainers usually fall into at least the following three situations and their associated dilemmas.

In the first situation the child has access to a gait trainer and/or stander but, because of its size and/or weight it can not be easily transported with the child from location to location. Choosing to keep the child near the equipment during free time may provide the child with sufficient daily opportunities for assisted standing and walking, though unfortunately this common choice may sacrifice much of the child's contact with the outside environment including visits to family and friends, shopping and errands, long vacations, touring and travelling and even playgrounds. Further, this emphasis on the child's motor development may result in a negative influence on the young child's cognitive and social development and may limit the entire family's activities.

The second situation exists when the child is deprived of sufficient daily standing and gait training for either one of the two following reasons. First, the equipment may not be available because of cost, size and/or difficulty of transporting it between locations. Second, the equipment may be available, but the parents/caretakers do not plan the child's and family's daily activities in such a way that will keep the child within easy reach of the equipment. In both situations the child and family may have the advantage of increased mobility in the community with the benefit to the child of greater exposure to the environment outside of home and school. However, the child will probably spend increased time sitting in chairs, strollers, and wheelchairs and/or lying on the couch, bed or floor. As a result, the child may be denied a sufficient daily quantity of standing and gait training, thereby impeding improvement and maintenance of motor abilities.

The third situation effects children who normally ambulate using walkers, canes and crutches and want to participate in activities that demand that their hands be free. Standers and walkers currently being used demand that the children dedicate one or two hands to grasp it. Therefore, these devices are not useful for children who want or need for their hands to be free for activities while they are standing or walking.

Attempts to enable disabled children to stand and walk with their hands free are met by an adult either holding the child or by using a support harness, neither of which is satisfactory.

An adult, using one or two hands, may guide the child in standing or walking in any desired indoor or outdoor location. However, this type of assistance is exhausting and physically demanding for the adult.

When using a child's body harness, the adult must hold one or two hands above the child's shoulder, depending on how the harness is designed. This type of assistance is also exhausting and physically demanding for the adult.

Without the harness, the adult must support the child with two hands and either be on his/her knees, crouched, or bent over to accommodate the child's height. Compared to standing, gait training often demands that the adult assist the child with its leg movements in addition to providing balance and support at the trunk. It is difficult for one adult alone with or without a support harness to adequately provide for the child's needs in standing and gait training. Further, the adult's hands are not free for any other activities including the child.

Except when another able-bodied adult is present, when the adult wants to engage in an activity that requires adult involvement, the child's activity must be interrupted and the child must be moved to a sitting (when possible) or lying position so that the adult's hands are free. This is not desirable for the child and often is not possible in an outdoor environment.

SUMMARY OF THE INVENTION

With the foregoing in mind, the invention relates to a device for enabling a larger person to assist a smaller disabled person to learn to stand and to walk while keeping the hands of both persons free for other tasks. The device comprises two body harnesses and a foot harness. One of the body harnesses is worn by the larger person and the second body harness is worn by the smaller person. The foot harness is worn by both persons. Means are provided for connecting the first and second harnesses to enable the smaller person to have substantial freedom of movement while the larger person supports and assists the smaller person to walk.

In another aspect, the invention relates to a device for enabling a larger person to assist a smaller disabled person to learn to stand and walk while keeping the hands of both persons free for other tasks. The device comprises a harness which is worn by the larger person. The harness has means for being connected to the smaller person so that the smaller person has substantial freedom of movement while the larger person assists the smaller person to walk.

In still another aspect, the invention relates to a device to be worn by a smaller disabled person to learn to stand and walk with the assistance of a larger person while keeping the hands of both persons free for other tasks. The device comprises a body harness that is worn by the smaller person. The body harness comprises a belt that includes first and second groups of connectors. The first group of connectors comprises two connectors. The second group of connectors comprises one connector. The one connector in the second group is disposed between the two connectors in the first group. The first and second group of connectors are used selectively or simultaneously to connect the smaller person to the larger person.

In still another aspect, the invention relates to a device for enabling a larger person to assist a smaller disabled person to learn to stand and walk comprising a foot harness. The foot harness comprises a support that is large enough to simultaneously support the foot of the larger person and the foot of the smaller person. Straps are connected to the support for connecting the foot of the larger person and the foot of the smaller person to the support.

In a still further aspect, the invention relates to a method for enabling a larger person to assist a smaller disabled person to learn to stand and to walk while keeping the hands of both persons free for other tasks comprising the steps of connecting the back of the smaller person to the trunk of the larger person so that the larger person can assist the smaller person while maximizing the freedom of movement of the smaller person.

DETAILED DESCRIPTION OF THE INVENTION

Figure 1:
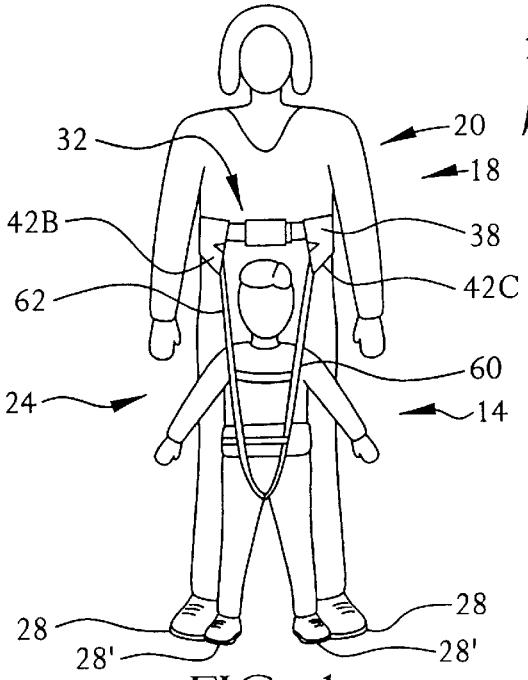
FIG. 1 is a front elevation view of the device of the invention being worn by a larger person and a smaller person.
Figure 2:
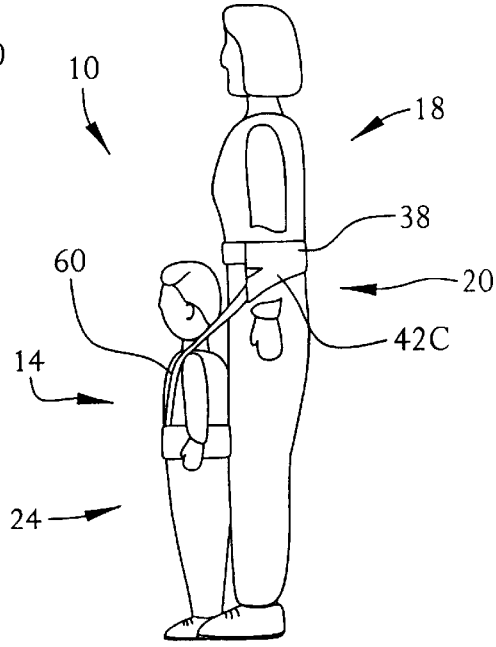
FIG. 2 is a side elevation view of the device of the invention shown in FIG. 1 being worn by a larger person and a smaller person.

Now referring to the drawings for a detailed description of presently preferred forms of the invention and where like numerals indicate like elements throughout the several views, FIGS. 1 and 2 show a device 10 constructed generally in accordance with a preferred form of the invention.

The device 10 is being worn by both a smaller person 14 such as a young child who may not have the ability to stand or walk independently as a result of a congenital or after birth injury, and a larger person 18, perhaps a parent or other adult who assists the smaller person 14 to stand, walk, or engage in other activities which require movement of the legs while keeping the hands of both persons free for other activities.

The device 10 includes a first body harness 20 to be worn by the larger person 18 and a second body harness 24 to be worn by the by the smaller person 14. A suitable means 32 releasably connects the first and second body harnesses 20 and 24.

Additionally, both the smaller person 14 and the larger person 18 may wear foot harnesses 28, 28' on each foot. As will be explained more completely, each foot harness 28, 28' is worn simultaneously by the smaller person 14 and the larger person 18 with their same side feet (left-left and right-right) connected to each foot harness 28, 28'.

As best seen in FIGS. 1–3C, the first body harness 20 comprises a belt 38 which may be comprised of leather, fabric, plastic or the like. The belt 38 is adapted to fit around the trunk of the larger person 18. Its ends may be interconnected in a conventional manner by a latch or buckle 40 to secure the belt 38 around the trunk of the larger person.

Figure 3A:
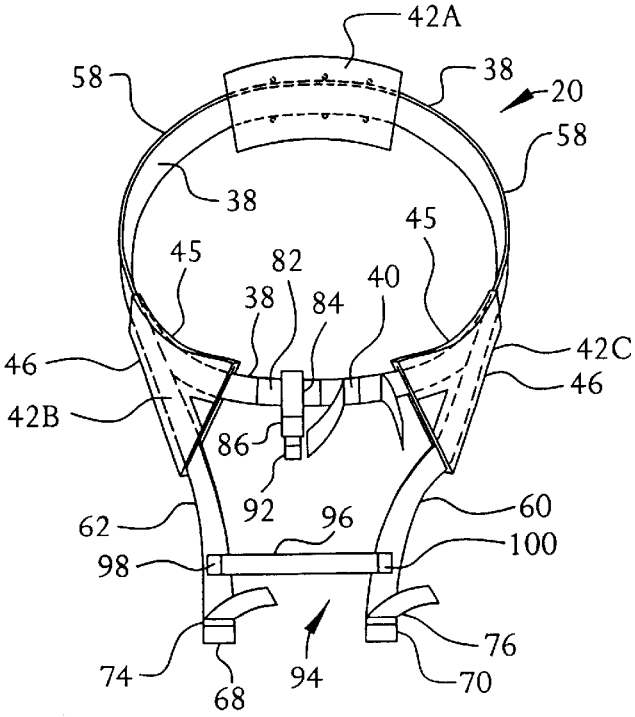
FIG. 3A is a view of one form of the larger person's harness of the invention.
Figure 3B:
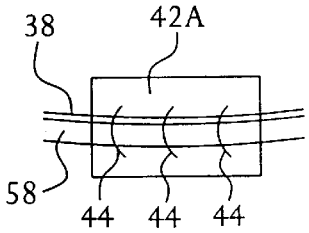
FIGS. 3B and 3C are views of parts of the harness shown in FIG. 3A.
Figure 3C:
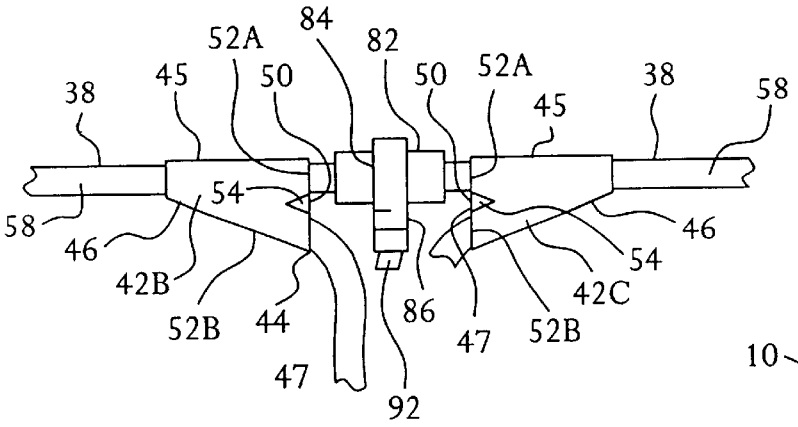

Fixed to the belt 38 as by sewing, snaps or gluing so as to be at the back of the larger person 18 is a padded member 42A. The padded member 42A may include on its outside a sleeve or a plurality of loops 44 (FIG. 3B). Additionally, on each side of belt 38 are second and third padded sleeves 42B and 42C (FIGS. 3A and 3C). The second and third padded sleeves 42B and 42C are generally triangularly shaped with one side 45 lying along and being supported by belt 38 and a second side 46 extending forwardly and downwardly to define a relatively large opening 47 along the third side 50. If preferred, the large opening 47 may be divided into two smaller openings 52A and 52B by stitching or the inclusion of a web 54.

The belt 38 is worn by the larger person 18 with the sleeve 44 at the back of the larger person's body and with the second and third padded sleeves 42B and 42C extending around the body of the larger person so that the end openings 48 or 52A and 52B terminate generally between the outside and middle of the thighs of the larger person 18 as will be explained more fully.

An elongated flexible member 58 which may be made from fabric, leather, plastic or other suitable material may be slidably received in the sleeves 44 and 42B 42C. First and second end portions 60 and 62 of the elongated flexible member 58 extend from the sleeves 44 and 42B 42C. As will be explained more fully, the elongated flexible member 58 is advantageously employed to support some of the weight of the smaller person. In this regard the triangular shape of sleeves 42B and 42C is especially advantageous since the sloping side 46 reduces the likelihood that the material comprising the sleeves or their stitching will be torn by the weight of the smaller person 14.

The distal end of each end portion 60 and 62 includes a connector 68 and 70 to be connected to the second body harness 24 as will be more fully explained. Further, each of end portions 60 and 62 can be provided with suitable means 74 and 76 for adjusting its length.

As seen in FIG. 3A, the connection means 32 for connecting the first and second body harnesses 20 and 24 to each other is connected to the belt 38. Connection means 32 may include a rigid, long, flat hollow member reenforcement 82 (FIG. 3C) that lies across the body of the larger person 18 and slidably receives belt 38. The reenforcement member 82 passes through a loop 84 at the upper end of a downwardly extending strap 86. For convenience of description, the connection means may be characterized a group of connection means where the group comprises only one connection means 32. However, if desired a plurality of connection means 32 could be employed.

The strap 86 has a connector such as the spring loaded connector 92 connected to its lower end. The strap 86 may be provided with adjustment loops at each end (not shown) to accommodate people of different sizes and heights. As will be explained more fully, the connector 92 is to be connected to a complementary member on the second body harness 24.

The length and rigidity of reenforcement member 82 are especially advantageous since they reduce the likelihood that the belt 38 will sag under the weight of the smaller person 14 and become less effective as a support for the smaller person.

Still further, as seen in FIG. 3A, suitable means 94 may be provided for retaining the first and second portions 60 and 62 of the elongated flexible member 58 in generally parallel relation to each other so that they do not overlap or slide off the child's shoulders, thus disturbing the use of the child's arms and perhaps eventually sliding off the child's shoulders and preventing proper trunk support.

In one form (FIG. 3A), the means 94 comprises a second elongated member 96 which is connected by complementary latching members 98 and 100 to the first and second end portions 60 and 62. As is well understood, the complementary latching members 98 and 100 could be comprised of Velcro, snaps, buckles or the like.

Further, the complementary latching members 98 and 100 could be permanently connected or there could be loops (not shown) so that the member 96 can slide along first and second end portions 60 and 62 and be connected to the first and second end portions 60 and 62 at the appropriate height that provides crucial support, but only up to the height of the child's armpits.

However, it is preferred that the second elongated member 96 be restrained against freely sliding movement along the first and second end portions 60 and 62 since it may slide to the top of the end portions while the larger person is distracted will be a disturbance in the child's neck area, or slide down and be ineffective if it is too far down. Therefore, it is preferred that the complementary latching members 98 and 100 be fixable to the second end portions 60 and 62 in a plurality of locations along the second end portions 60 and 62 to prevent the second elongated member from moving.

Figure 4:
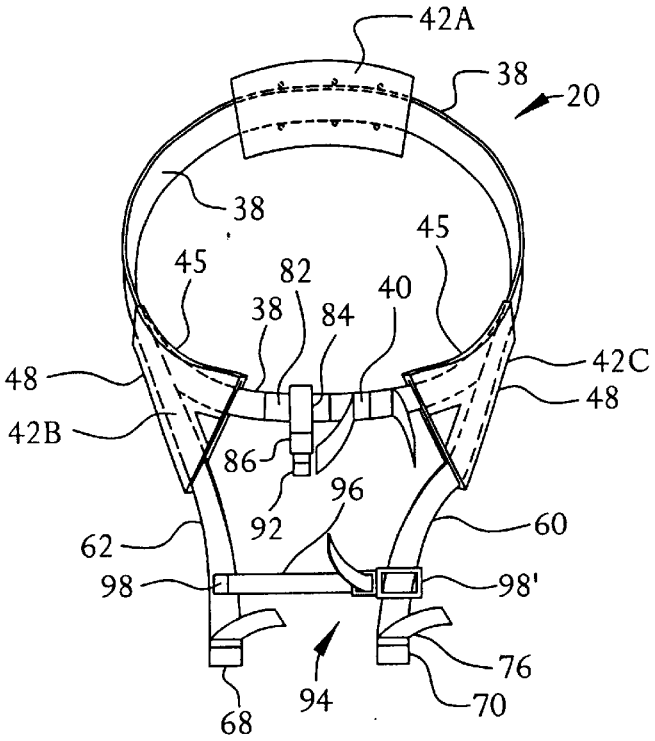
FIG. 4 is a view of another form of the harness shown in FIG. 3A.

As an alternative, as seen in FIG. 4, proper and adjustable placement can achieved if the loop/fastener at one end of second elongated member 96 is restrained against movement as by one of the connection means described and its other end is slidable along one of the end portions by a suitable slidable and adjustable fastener 98'.

Figure 5A:
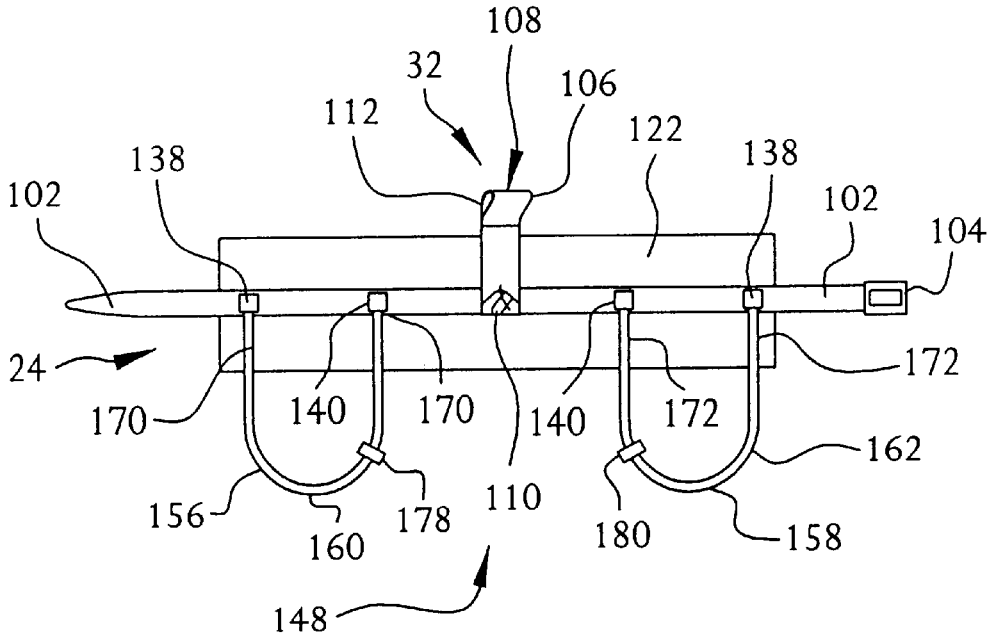
FIG. 5A is a view of the smaller person's harness of the invention.

As best seen in FIGS. 1, 2, and 5A the second body harness 24 comprises a belt 102 with at least one buckle or latch 104 to secure the belt 102 around the trunk of the smaller person 18. The buckle or latch 104 could be in the front or on the side.

A second connector 106 which is a part of releasable connection means 32 is connected belt 102 intermediate its ends. The second connector 106 may comprise a strap 108 which is connected at one end to the belt 102 by stitching 110. The other end of strap 108 may include a loop 112 which is adapted to receive the aforementioned connector 92 on the first body harness 20.

The belt 102 may be padded along its entire length by a cushion 122 to provide protection and support for trunk of the smaller person. Further, if the pad is relatively wide (in a vertical direction while being worn) it will further support the smaller person's trunk. In any event, the belt 102 supports cushion 122 which is located on the belt 102 so that it surrounds the body of the smaller person 14. Preferably, the cushion 122 overlies the portion of the trunk including the hips of the smaller person 14. The cushion 122 may be held in place on the belt 102 by stitching, snaps or other suitable fasteners.

However, it is within the scope of the invention for the cushion 122 to be provided with loops or transverse openings (not shown) so that it can be slidably positioned on the belt 102.

Figure 5B:
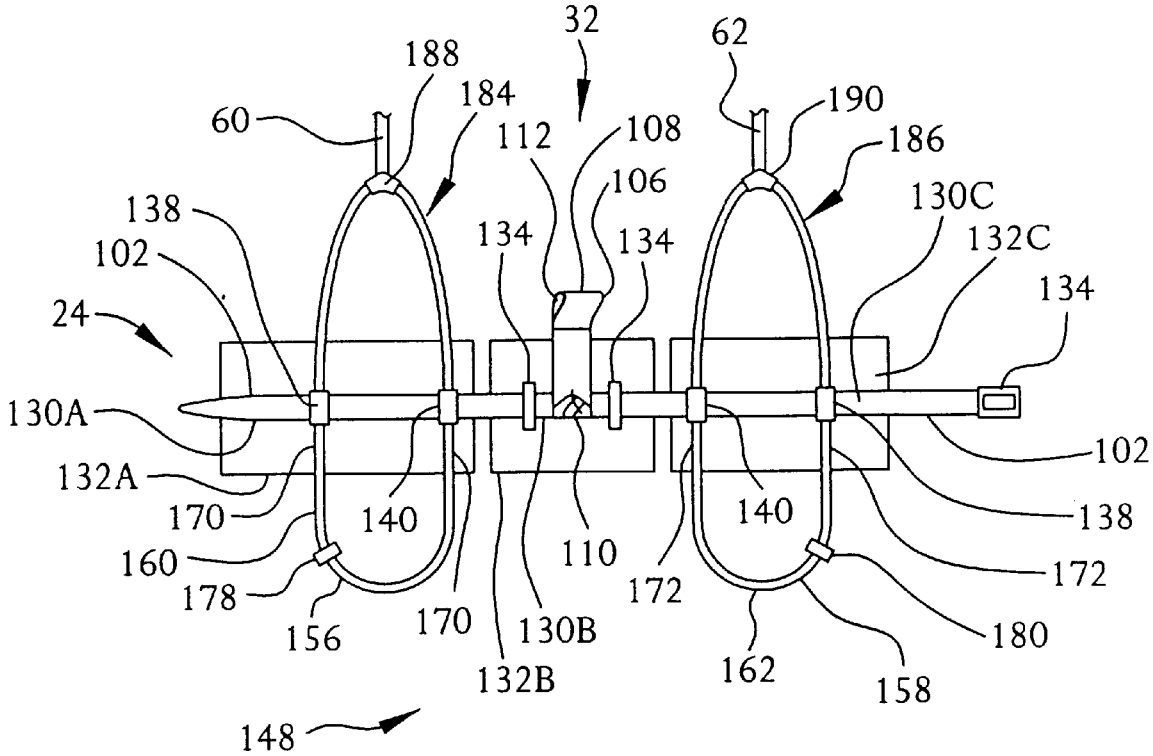
FIG. 5B is a view similar to FIG. 5A but showing a different form of the smaller person's harness of the invention.

In the alternative as seen in FIG. 5B the belt 102 may comprise several sections; 130A, 130B, and 130C each of which carries its own cushion 132A, 132B, 132C. Adjacent sections are held together by connectors such as buckles or latches 134 so that the length of belt 102 can be adjusted to tighten it or loosen it around the trunk of the smaller person. Further, if two or three buckles or latches 134 are used they can be located on each side as well as on the front.

As seen in FIGS. 5A and 5B, the belt 102 comprises a group of front connectors comprising the two front connectors 138 and a group of rear connectors comprising the two rear connectors 140. It is possible to designate the connectors 138 and 140 as "front" and "rear" because they are sufficiently spaced so that when the body harness 24 is worn by the smaller person 14, the connectors 138 are in the front of the smaller person 14 while the connectors 140 are at the rear.

As is apparent, the provision of both front and rear connectors 138 and 140 is advantageous since it provides alternatives for connecting the connectors 68 and 70 on the first and second end portions 60 and 62 of the elongated flexible member 46 to the second body harness 24. Thus, the first and second end portions 60 and 62 can be connected to the rear connectors 140 to maximize the freedom of movement of the smaller person 14 since in that configuration the smaller person 14 is free to stand erect independently, to bend forward and to rotate the trunk.

However, if the smaller person 14 does not have sufficient truncal control to stand erect independently, then the first and second end portions can be connected to the front connectors 138 so that the smaller person 14 receives extra postural support to the trunk from the larger person 18.

Suitable means 148 are provided for preventing the smaller person 14 from sliding through belt 102 while engaging the thighs of the smaller person 14 to minimize the likelihood of damage to the inner pelvic structures.

Preferably, the means 148 comprise leg loops 156 and 158 which are connected to the belt 102. The leg loops 156 and 158 are used advantageously to also assure that the second body harness 24 remains at a height on the smaller person's trunk that is appropriate for that person's truncal control.

Each of the leg loops 156 and 158 comprises a strap 160 and 162 which is releasably connected at its ends 170 and 172 to one of the connectors 138 and 140 which may be buttons, snaps or buckles on the belt 102. As an alternative one of the ends of each of the straps 160 and 162 could be permanently connected to the belt 102 by stitching or the like. Stitching is advantageous since it removes the possibility that the straps 160 and 162 might be lost or misplaced.

Suitable means such as adjustment buckles 178 and 180 can be provided for changing the length of the straps 160 and 162. This is especially advantageous since the height of the second body harness 24 on the smaller person 14 can be raised or lowered in accordance with the smaller person's truncal control. Thus, as explained earlier, in the case of a smaller person 14 whose trunk is relatively weak, the straps 160 and 162 can be lengthened so that the belt 102 rides high on the smaller person's trunk.

On the other hand, in the case of a smaller person 14 whose upper body is stronger, the straps 160 and 162 can be shortened. This will result in the belt 102 being lower on the trunk of the smaller person 14.

Significantly, the straps 160 and 162 engage the thighs of the smaller person 14 rather the crotch. This reduces the likelihood of damage to the inner pelvic structures of the smaller person 14.

If the smaller person has a severe disability, additional support may be provided by providing additional support straps on the second body harness 24. As best seen in FIG. 5B shoulder straps 184 and 186 are provided on each side of the second body harness 24. They may be connected to front and rear connectors 138 and 140 on each side of second body harness 24. The shoulder straps 184 and 186 may be crossed in back of the smaller person 14 or they may go straight over the smaller person's shoulders.

Each shoulder strap 184 and 186 includes a connector 188 and 190 to enable it to be connected to the first and second end portions 60 and 62 of the elongated flexible member 58. The shoulder straps 184 and 186 further limit the child falling forward and backward and may be especially helpful with infants.

Figure 6:
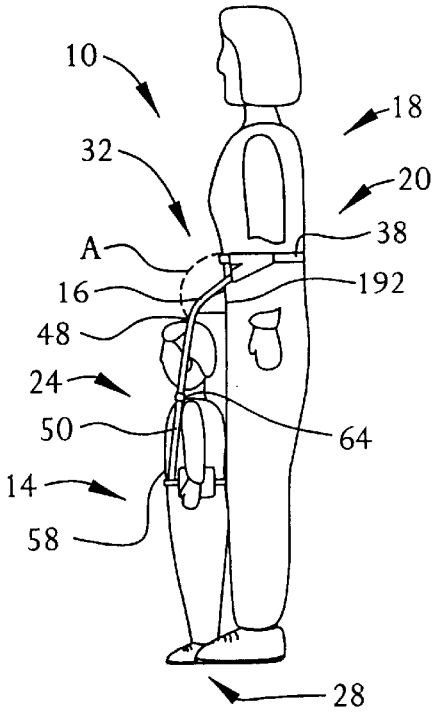
FIG. 6 a view similar to FIG. 1 but showing a different feature of the invention.
Figure 7:
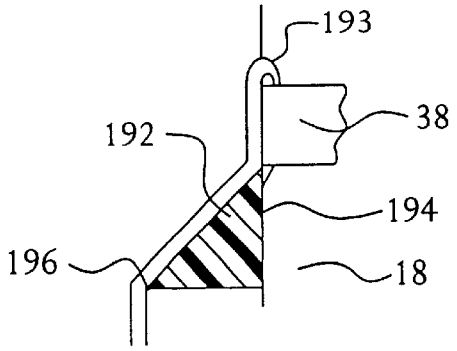
FIG. 7 is a view of detail A of FIG. 6.

Referring to FIGS. 6 and 7, suitable means such as elongated stiff pad 192 which can be made from a hard foam can be connected to the belt 38 on the first body harness 20 by loops 193. The pad 192 extends across the waist of the larger person 18 and is generally triangular in cross section so that its base 194 lies against the larger person 14 and its apex 196 extends over the shoulders of the smaller person 14 so that the extent to which first and second end portions 60 and 62 bear against the body of the smaller person 14 is reduced.

Placing of the apex 196 over the shoulders of the smaller person diminishes the likelihood that the end portions 60 and 62 will press the smaller person 14 back against the strap 86 and the legs and body of the larger person 18 to thereby interfere with any attempt by the smaller person 14 to stand erect.

Figure 8A:
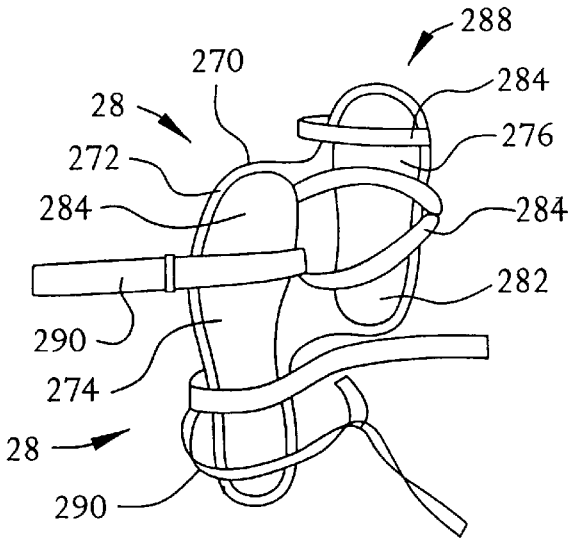
FIGS. 8A and 8B are views of two forms of the shoe harness of the invention.
Figure 8B:
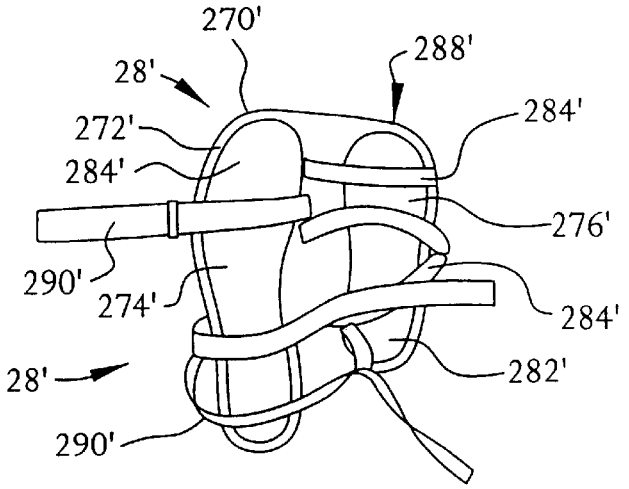

Referring to FIGS. 8A and 8B, the foot harness 28, 28' worn by the left foot of the smaller person 14 and the left foot of the larger person 18 is shown; it being understood that the foot harness 28, 28' for the right side is the mirror image. In the embodiment of the foot harness shown in FIG. 8A the toe of the smaller person is in front of the toe of the larger person while in the embodiment shown in FIG. 8B the toe of the smaller person is even with the toe of the larger person.

The foot harness 28, 28' is preferably in the form of a snadal 270, 270' which can be worn over the shoes or bare feet of both persons while walking. The sandal 270, 270' comprises a support 272, 272' which is large enough to simultaneously support the same side foot of the smaller person 14 and the larger person 18.

The support 272, 272' is comprised of a suitable flexible material so that the smaller person learns to roll the front part and toes of the feet while being assisted in walking.

The foot harness 28, 28' comprises a portion 274, 274' for the larger person's foot and a portion 276, 276' for the smaller person's foot on the same side of the body. It should be noted that portion 274', 274' is located relative to portion 272, 272' so that the heel 282, 282' of the smaller person's foot is disposed generally adjacent the front 284, 284' of the larger person's foot.

A first set of straps 288, 288' are provided for connecting the smaller person's foot to the support 272, 272' while a second set of straps 290, 290' is provided for connecting the foot of the larger person to the support 272, 272'.

Preferably, the foot harness 28, 28' is made from a light weight material since it may be worn by children as young as eight months old. Further, protective padding may be used over the straps to protect the feet of very young children.

The device 10 which has just been described can be used in several ways in accordance with the extent of the disability of the smaller person. If the smaller person has minimal strength and coordination, the foot harnesses 28, 28' are used in conjunction with the body harnesses 24 and 26. In particular, it should be appreciated that the body harnesses 20 and 24 can be worn with the first and second end portions 60 and 62 extending over the shoulders of the smaller person 14 and connected to the front connectors 138 to prove maximum support for the smaller person's upper body. Further, the upper body support can be increased by shortening strap 108 and loosening the straps 140 and 142 so that the belt 102 on the smaller person 14 is high on the trunk.

As the smaller person 14 gains truncal control, the height of the belt 102 on the trunk or pelvis can be lowered and the first and second end portions 60 and 62 repositioned so that they are behind the smaller person 14 and are connected to the rear connectors 140 to require a greater effort by the smaller person to remain erect.

Ultimately, the elongated flexible member 58 can be dispensed with so that the only connection between the two body harnesses 20 and 24 is the releasable connection means 32 comprising the connector 92 and loop 112. Thus, the first and second end portions 60 and 62 can be dispensed with if the smaller person 14 has substantial strength, while still disabled.

In this regard it should be noted that the groups of connectors 32, 138 and 140 engage the belt 102 on the second body harness 24 so that the weight of the smaller person 14 is not carried by the cushions 122 and 132A, 132B and 132C.

Further, as the smaller person 14 develops increased walking skills, the foot harnesses 28, 28' can be removed as is appropriate. However, care must be taken to prevent the smaller person from accidentally pivoting to the floor. To some extent the risk of this occurring can be reduced by relying on the elongated flexible member 58 whose first and second end portions 60 and 62 are connected to the belt 102, or by raising the belt 100 higher on the trunk as described. In the latter circumstance, the connection between the larger and smaller person can be either through the elongated flexible member 58 and its first and second end portions 60 and 62, or through the strap 86, or by using both of them.

Still further, it is apparent that apparatus made in accordance with the invention could be comprised of water resistant or waterproof material so that it can be used in a environment such as inclement weather, while bathing, or showering, while in a swimming pool, or the like.

While the invention has been described with regard to several embodiments, it is apparent that others will obvious to those skilled in the art. Thus, the invention should not be limited by the foregoing description, but rather, only by the scope of the appended claims.

What is claimed is:

1. An apparatus for assisting a larger person to assist a smaller disabled person to learn to stand and to walk while keeping the hands of both persons free for other tasks comprising first and second body harnesses and a foot harness, said first harness to be worn by said larger person, said second harness to be worn by said smaller person, and said foot harness to be worn by both of said persons, and means for connecting said first and second harnesses to enable the smaller person to have substantial freedom of movement while said larger person assists said smaller person to walk.

2. An apparatus as defined in claim 1 wherein said first harness comprises a strap adapted to be worn around the trunk of the larger person, first and second elongated flexible members supported by said strap, said elongated flexible members comprising first and second portions, first and second connectors at each of the ends of said first and second portions of said elongated flexible members for being releasably connected to second harness assist said smaller person as said smaller person's trunk rotates while walking or standing.

3. An apparatus as defined in claim 2 including adjustment means on said first and second portions for selectively changing their length to vary the assistance that said elongated members provide to said smaller person.

4. An apparatus as defined in claim 2 including a third connector connected to said strap, and said third connector is for being releasably connected to second harness.

5. An apparatus as defined in claim 2 wherein said first harness includes means for retaining said first and second portions of said elongated flexible members so that they will be substantially between the outside and the, middle of the thighs of the larger person.

6. An apparatus as defined in claim 5 wherein said means for retaining said first and second portions of said elongated flexible members comprises a second elongated member, and complementary means on first and second portions and on the distal ends of said second elongated member for releasably connecting said first and second portions to said distal ends of said second elongated member.

7. An apparatus as defined in claim 5 wherein said strap comprises a sleeve, said first and second elongated flexible members are connected to each other and are slidably and telescopically received in said sleeve, and said means for retaining said first and second portions of said elongated flexible members so that they will be substantially between the outside and the middle of the thighs of the larger person comprises locating the ends of said sleeve so that they will substantially overlie connectors on said second harness that are for connecting said harnesses to each other.

8. An apparatus as defined in claim 1 wherein said strap comprises a sleeve, said first and second elongated flexible members are connected to each other and are slidably and telescopically received in said sleeve, said sleeve having first and second ends, and said first and second portions of said elongated flexible members extend from said ends of said sleeve.

9. An apparatus as defined in claim 8 wherein said first and second ends of said sleeve are connected to said strap so that their ends are substantially between the outside and the middle of the thighs of the larger person.

10. An apparatus as defined in claim 9 wherein said first and second ends are generally triangularly shaped so that said first and second ends portions slope downwardly and forwardly in said sleeves.

11. An apparatus as defined in claim 9 wherein said sleeve comprises a plurality of sections, two of said sections being located on said strap so that they will lie along the side and front of the larger person.

12. An apparatus as defined in claim 11 wherein said first and second ends are defined by said two sections of said sleeve, and said first and second ends are located so that they are substantially between the outside and the middle of the thighs of the larger person.

13. An apparatus as defined in claim 1 wherein said second harness comprises a belt, said belt including first and second spaced connectors for being connected to complementary connectors on said first harness, and a third connector disposed between said first and second spaced connectors.

14. An apparatus as defined in claim 13 wherein said first, second and third connectors are on said second harness so that they are between the larger and smaller persons.

15. An apparatus as defined in claim 13 wherein said first, second connectors are connected to said second harness so that they are in front of the smaller person, and the third connector is connected to said second harness so that it is between the larger and smaller persons.

16. An apparatus as defined in claim 15 including means for holding said first and second portions of said elongated strap away from the body of the larger person so that they lie in a vertical plane and are connected to said first and second connectors.

17. An apparatus as defined in claim 1 wherein said second harness comprises a belt, means for cushioning the trunk of said smaller person supported by said belt, said belt supporting first and second pairs of spaced front and rear connectors for being selectively connected to complementary connectors on said first harness, said pair of front connectors being in front of said smaller person, and said pair of rear connectors between said persons.

18. An apparatus as defined in claim 17 wherein said belt supports a third connector for being disposed between said persons.

19. An apparatus as defined in claim 17 wherein said third connector comprises a loop for receiving means defining a shackle.

20. An apparatus as defined in claim 17 wherein said cushioning means is for overlying the trunk of the smaller person, and said first and second pairs of connectors are supported by said belt.

21. An apparatus as defined in claim 20 wherein said cushioning means comprises at least one cushion.

22. An apparatus as defined in claim 20 wherein said belt comprises a plurality of sections, means for connecting adjacent ones of said sections, said connecting means being for changing the length of said belt, and a cushion supported by each of said sections.

23. An apparatus as defined in claim 20 including means for preventing said smaller person from sliding through said belt.

24. An apparatus as defined in claim 23 wherein said means for preventing said smaller person from sliding through said belt comprises leg loops connected to said belt.

25. An apparatus as defined in claim 24 wherein said leg loops comprise straps, and and at least one end of each of said straps comprises a connector that is releasably connected to a complementary connector on said belt.

26. An apparatus as defined in claim 24 including means for changing the length of said straps comprising said leg loops so that said belt can be higher on the body of a weaker smaller person and lower on the body of a stronger smaller person.

27. An apparatus as defined in claim 23 wherein said means for preventing the smaller person from sliding through said belt engages the thighs of the smaller person to avoid damage to the inner pelvic structures of the smaller person.

28. An apparatus as defined in claim 27 wherein said support is comprised of a flexible material so that the smaller person learns to roll its foot as it is assisted in walking.

29. An apparatus as defined in claim 17 including means for releasably connecting said belt to said smaller person.

30. An apparatus as defined in claim 29 including shoulder straps, said shoulder straps being for connection to said belt for extending over the shoulders of the smaller person to provide additional support, and means on said shoulder straps for being connected to said first harness.

31. An apparatus as defined in claim 1 wherein said foot harness comprises a support, said support being large enough to simultaneously support the same side foot of the larger and smaller person, first and second sets of straps connected to said support, said first set straps being for connecting the foot of said smaller person to said support, and the second set of straps being for connecting the foot of said larger person to said support, and said first and second sets of straps are connected to said support so that the heel of the smaller person is generally along side the front of the larger person's foot so that the smaller person's leg will be in front of the larger person's leg and the larger person can guide the foot of the smaller person.

32. An apparatus as defined in claim 1 wherein said foot harness comprises a support, said support being large enough to simultaneously support the same side foot of the larger and smaller person, first and second sets of straps connected to said support, said first set straps being for connecting the foot of said smaller person to said support, and the second set of straps being for connecting the foot of said larger person to said support, and said first and second sets of straps are connected to said support so that the toe of the smaller person is generally along side the toe of the larger person's foot so that the smaller person's leg will be in front of the larger person's leg and the larger person can guide the foot of the smaller person.

33. An apparatus for assisting a larger person to assist a smaller disabled person to learn to stand and to walk while keeping the hands of both persons free for other tasks comprising a body harness, said body harness to be worn by said larger person, said body harness comprising a strap adapted to be worn around the waist of the larger person, said strap comprising a sleeve, an elongated flexible member telescopically and slidably received in said sleeve, first and second portions of said elongated flexible member extending from said sleeve, and first and second connectors at each of the ends of said first and second portions of said elongated flexible member for being releasably connected to the smaller person so that said elongated flexible member slides in said sleeve to continue to assist said smaller person as the smaller person's trunk rotates while walking and standing so that said smaller person has substantial freedom of movement while said larger person guides said smaller person to walk.

34. An apparatus as defined in claim 33 including adjustment means on said first and second portions for selectively changing their length to vary the assistance that said elongated member provides to said smaller person.

35. An apparatus as defined in claim 33 including a third connector connected to said strap, and said third connector is for being releasably connected to said smaller person.

36. An apparatus as defined in claim 33 wherein said harness includes means for retaining said first and second portions of said elongated flexible member so that they are substantially between the outside and the middle of the thighs of the larger person.

37. An apparatus as defined in claim 36 wherein said means for retaining said first and second portions of said elongated flexible member in substantially parallel relation comprises a second elongated member, and complementary means on first and second portions and on the distal ends of said second elongated member for releasably connecting said first and second portions to said distal ends.

38. An apparatus as defined in claim 36 wherein said means for retaining said first and second portions of said elongated flexible member in substantially parallel relation comprises means for locating the ends of said sleeve so that they will overlie the front of the smaller person.

39. An apparatus to be worn by a smaller disabled person to learn to stand and to walk with the assistance of a larger person to assist while keeping the hands of both persons free for other tasks comprising a body harness to be worn by said smaller person, said second harness comprising a belt, said belt including first and second spaced connectors for being connected to the larger person, and a third connector disposed between said first and second spaced connectors.

40. An apparatus as defined in claim 39 wherein said first, second and third connectors are on said harness so that they will be between the larger and smaller persons.

41. An apparatus as defined in claim 40 wherein said first and second connectors are connected to said harness so that they are in front of the smaller person, and the third connector is connected to said second harness so that it will be between the larger and smaller persons.

42. An apparatus as defined in claim 41 including means for holding said first and second portions of said elongated strap away from the body of the larger person so that they lie in a vertical plane and are connected to said first and second connectors.

43. An apparatus as defined in claim 39 including means for cushioning the trunk of said smaller person supported by said belt, said belt supporting first and second pairs of spaced front and rear connectors for being selectively connected to complementary connectors on said first harness, said pair of front connectors being in front of said smaller person, and said pair of rear connectors being behind said smaller person.

44. An apparatus as defined in claim 43 wherein said belt supports a third connector for being disposed behind said smaller person.

45. An apparatus as defined in claim 43 wherein said third connector comprises a loop for receiving a shackle.

46. An apparatus as defined in claim 43 wherein said cushioning means comprises pads for overlying the hips of the smaller person, and said first and second pairs of connectors are supported by said belt.

47. An apparatus as defined in claim 46 including means for preventing said smaller person from sliding through said belt.

48. An apparatus as defined in claim 47 wherein said means for preventing said smaller person from sliding through said belt comprises leg loops connected to said belt.

49. An apparatus as defined in claim 48 wherein said leg loops comprise straps, and and at least one end of each of said straps comprises a connector that is releasably connected to a complementary. connector on said belt.

50. An apparatus as defined in claim 48 including means for changing the length of said straps comprising said leg loops so that said belt can be higher on the body of a weaker smaller person and lower on the body of a stronger smaller person.

51. An apparatus as defined in claim 46 wherein said means for preventing the smaller person from sliding through said belt engages the thighs of the smaller person to avoid damage to the inner pelvic structure of the smaller person.

52. An apparatus as defined in claim 43 including means for releasably connecting said belt to said smaller person.

53. An apparatus for assisting a larger person to assist a smaller disabled person to learn to stand and to walk comprising a foot harness, said foot harness comprising a support, said support being large enough to simultaneously assist the same side foot of the larger and smaller person, first and second sets of straps connected to said support, said first set straps being for connecting the foot of said smaller person to said support, and the second set of straps being for connecting the foot of said larger person to said support, and said first and second sets of straps are connected to said support so that the heel of the smaller person is generally along side the front of the larger person's foot so that the smaller person's leg and trunk will be in front of the larger person's leg and trunk.

54. An apparatus as defined in claim 53 wherein said support is comprised of a flexible material so that the smaller person learns to roll its foot as it is guided in walking.

55. A method for assisting a larger person to assist a smaller disabled person to learn to stand and to walk while keeping the hands of both persons free for other tasks comprising the steps of connecting the trunk of the smaller person to the larger person so that the larger person can assist the smaller person while maximizing the freedom of movement of the smaller person.

56. The method as defined in claim 55 including the step of connecting same side feet of the larger and smaller person so that the larger person can guide the smaller person to move their feet.

57. The method as defined in claim 56 including the step of placing the heel of the smaller person generally along side the front of the larger person's foot so that the smaller person's leg and trunk will be in front of the larger person's leg and trunk.

58. The method as defined in claim 56 wherein said step of connecting the same side feet comprises the step of providing a sandal for each of said sides, and said sandal is large enough simultaneously support the larger person's and smaller person's feet.

59. The method as defined in claim 58 wherein said sandal has A support, and including the step of comprising said support of a flexible material so that the smaller person learns to roll its foot as it is guided in walking.

60. The method as defined in claim 55 including the step of connecting the larger person to the smaller person above the waist of the smaller person.

61. The method as defined in claim 55 including the step of connecting the larger person to the smaller person below the waist of the smaller person.

62. The method as defined in claim 55 including the step of connecting the front of the larger person to both the front and the rear of the smaller person.

63. The method as defined in claim 55 including the step of connecting the front of the larger person to the front of the smaller person.

64. The method as defined in claim 55 including the step of connecting the front of the larger person to the rear of the smaller person.

* * * * *